United States Patent [19]

Pecht

[11] 4,134,521

[45] Jan. 16, 1979

[54] NAPKIN DISPENSING MECHANISM

[76] Inventor: Adam Pecht, 11924 Gurley Ave., Downey, Calif. 90242

[21] Appl. No.: 793,070

[22] Filed: May 2, 1977

[51] Int. Cl.[2] ..... B65H 3/22

[52] U.S. Cl. ..... 221/213; 74/45; 271/141

[58] Field of Search ..... 74/45, 38–40, 74/44; 271/141, 18.3; 221/210, 213, 214–216, 259, 36, 40

[56] References Cited

U.S. PATENT DOCUMENTS

| | | | |
|---|---|---|---|
| 416,340 | 12/1889 | Moodie | 221/259 |
| 2,258,358 | 10/1941 | Harvey | 221/36 |
| 2,444,389 | 6/1948 | Wagner | 221/215 |

*Primary Examiner*—Allen N. Knowles
*Assistant Examiner*—H. Grant Skaggs
*Attorney, Agent, or Firm*—William C. Babcock

[57] ABSTRACT

A mechanism for dispensing individual napkins from a napkin stack comprising a sliding actuator, spring biased to extend out of a dispenser housing, connected through a connecting rod to articulate a pivotally mounted advancing bell crank. The normal disposition of the bell crank deploys a pin on the free end thereof adjacent and within a slot on the underside of the napkin stack, the articulating arc of the pin around the pivot being such as to engage the underside of an individual napkin. As the bell crank is thus articulated the napkin is advanced through a slot for use.

3 Claims, 4 Drawing Figures

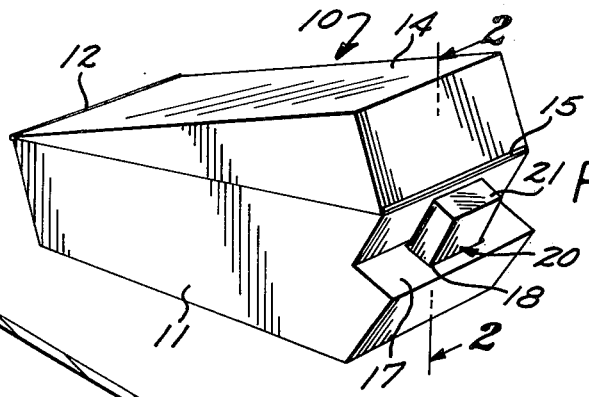
FIG. 1
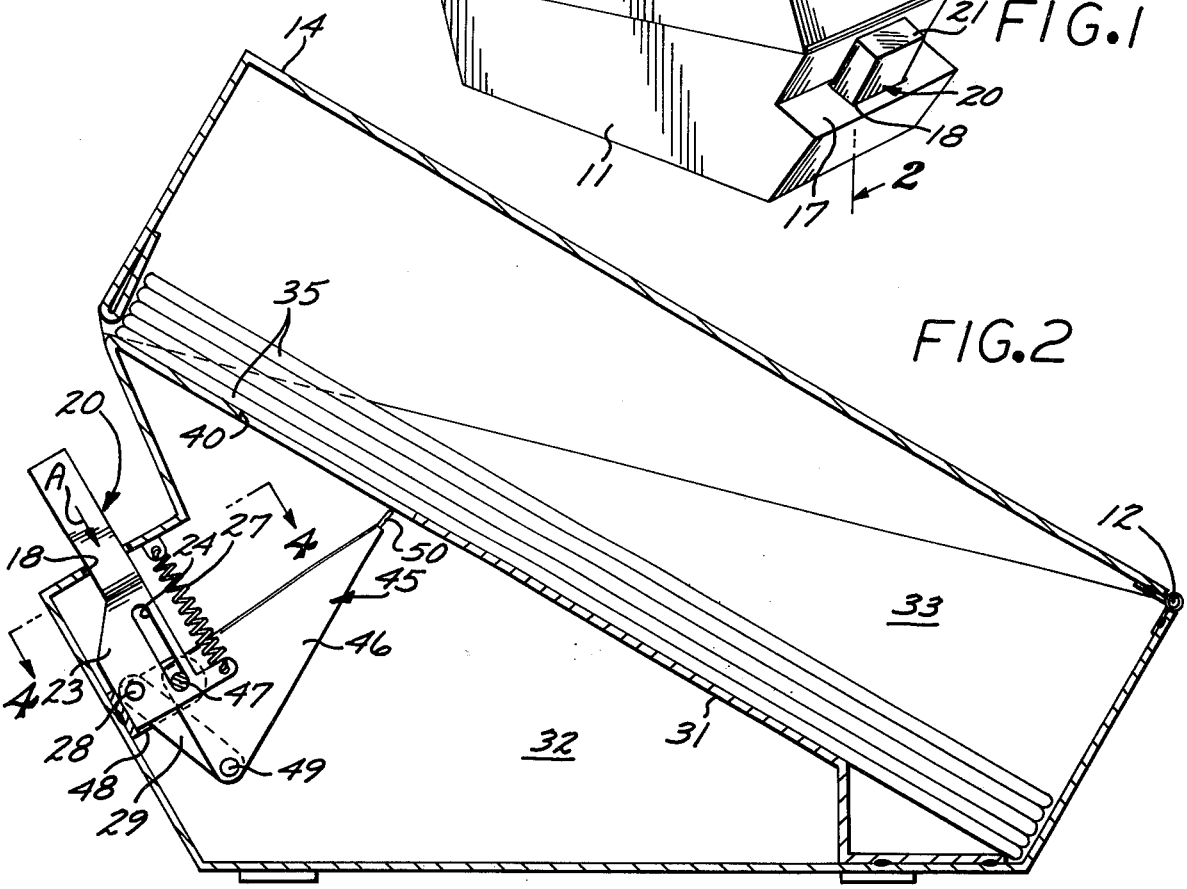
FIG. 2
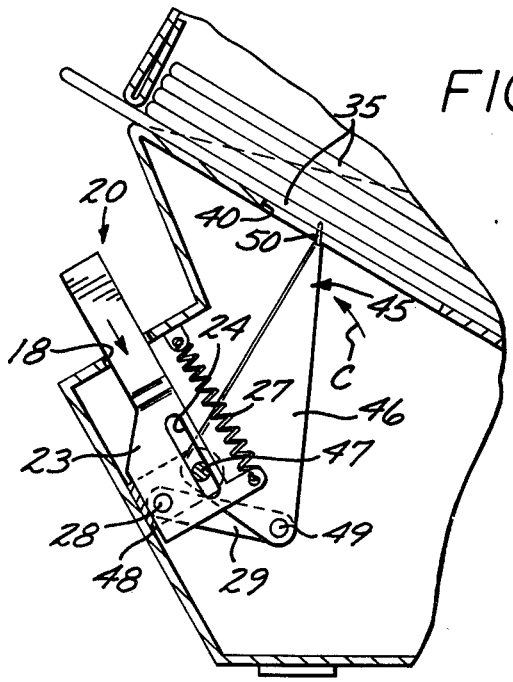
FIG. 3
FIG. 4
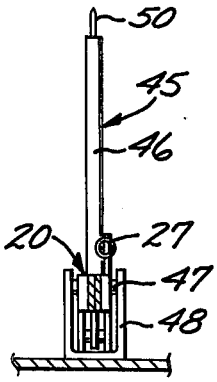

NAPKIN DISPENSING MECHANISM

BACKGROUND OF THE INVENTION

1. Field of the Invention

The present invention relates to dispensing mechanisms, and more particularly to mechanisms for dispensing individual napkins from a stack.

2. Description of the Prior Art

In the past, various dispensing mechanisms have been devised for deploying napkins both in commercial and home use. Most typically such dispensing mechanisms are of the manual type and the more prevalent types thereof requiring a spring bias on the napkin stack in order to maintain the napkins in alignment within a dispensing opening. Accordingly as the napkins are successively removed and the stack is depleted the free forces thereon progressively vary. The resulting range of spring forces therefore necessary often extends to force levels exceeding the pull strength of the napkin.

Alternatively interlaced napkin stacks are utilized through which the withdrawal of one napkin deploys the next napkin in succession. Thus the prior art dispensing techniques either entail complicated stacking requirements or exchange stacking height in favor of deployment convenience.

SUMMARY OF THE INVENTION

Accordingly it is the general purpose and object of the present invention to provide a napkin dispensing mechanism which is adapted to cooperate with various napkin stacks.

Further objects of the invention are to provide a dispensing mechanism for deploying paper articles, one by one, said mechanism utilizing the pivotal motion of a bell crank for such deployment.

Yet additional objects of the invention are to provide a napkin dispenser adapted to deploy singular napkins from a freely stored stack.

Yet additional objects of the present invention are to provide a napkin dispensing device which is convenient in use, simple in manufacture and requires few parts.

Briefly these and other objects are accomplished within the present invention by providing a dispensing enclosure comprising two chambers, the top chamber being conformed to the plan form of a folded napkin and adapted to contain a stack thereof and the bottom chamber including a dispensing mechanism. The separating wall between the top and the bottom chamber includes a slot formed therein through which a pivotally articulated bell crank extends during a portion of its articulating arc. The free end of the bell crank terminates in a pin which thus engages, through the communicating slot, a particular napkin, advancing such napkin along with its stroke to extend through a dispensing opening at the forward edge of the top chamber. To provide for the articulating motion of the bell crank the lower cavity, or the lower chamber, furthermore includes a pivot mount supporting the bell crank and a spring biased sliding actuator extending from a push-button surface on the exterior of the chamber into its interior. On the interior of the chamber the sliding actuator includes two slots disposed to engage the pivot of the bell crank and is thus maintained in a particular relationship relative the bell crank throughout the sliding stroke. Disposed between the sliding actuator and the bell crank is a connecting rod eccentrically displaced relative the pivot engaging slots and pivotally attached to the bell crank at a pivot radially displaced from the pivotal axis thereof.

By virtue of this arrangement of parts, an inward articulation of the push-button and the corresponding inward sliding motion of the actuator will produce an arcuate motion of the bell crank and the end pin thereof which by virtue of its alignment will intercept the underside of the napkin in the upper or the top chamber over a portion of a pivotal stroke. It is during this portion that engagement is made between the pin and the napkin, advancing the napkin out of the container. Once the push-button is released, the bias angle on the end pin allows for the withdrawal thereof from the napkin, the bell crank thus returning to its initial position for the next successive deployment.

BRIEF DESCRIPTION OF THE DRAWINGS

FIG. 1 is a perspective illustration of a napkin dispenser constructed according to the present invention;

FIG. 2 is a side view, in section, taken along line 2—2 of FIG. 1;

FIG. 3 is a detail view illustrating the articulating displacement of the dispensing mechanism shown in FIG. 2; and FIG. 4 is a front view in partial section taken along line 4—4 of FIG. 2.

DESCRIPTION OF THE SPECIFIC EMBODIMENT

While the following description is primarily directed to a napkin dispensing device such use is illustrative only. It is to be understood that articles other than napkins may be dispensed by the mechanism set out herein and no intent to limit the scope of the claims is expressed by this illustration.

As shown in FIG. 1 a napkin dispenser generally designated by the numeral 10 comprises a lower housing 11, generally rectangular in plan form joined by a hinge 12 to a lid assembly 14 shaped as a rectangular cube cut on a diagonal and conformed in plan form to mate with the housing 11. The lid assembly 14 is pivoted from hinge 12 to form a slot 15 on the radial end thereof with the corresponding edge of housing 11. It is through this slot that napkins are dispensed. To provide the necessary manipulative input for dispensing such napkins housing 11 includes a ledge 17 subjacent the slot 15, ledge 17 including an opening 18 through which a sliding actuator 20 extends into the interior of the housing. Actuator 20, in turn, terminates in a push-button flat 21 on the exterior and it is the translation of this flat that provides the articulating input or the manual articulative means for the dispensing sequence described hereinbelow.

More specifically as shown in FIG. 2 the push-button flat 21 advances the sliding actuator 20 inwardly in the direction of the arrow A towards the interior of housing 11. Housing 11 includes a separating surface 31 extending diagonally thereacross and dividing the housing into a lower cavity 32 and upper cavity 33. It is this upper cavity 33 which in combination with the lid assembly 14 provides the enclosure or repository for a napkin stack comprising napkins 35. The orientation of housing 11 and therefore the dividing surface 31 is essentially horizontal with the napkins being aligned by gravity in the confines of chamber 33 to maintain a stack configuration supported by the separating surface. Formed within the separating surface 31, in adjacent relationship with surface 17, is a longitudinal slot or opening 40 exposing the underside of the lowermost napkin 35 for engagement by a clawed bell crank assembly 45. Bell crank assembly 45, in turn, comprises a triangular bell crank 46 pivoted at one apex on a pivot rod 47 supported in a pivot mounting bracket 48 from the walls of housing 11, the alignment of pivot 47 being substantially across the axis of the inward motion of the sliding actuator 20.

Actuator 20, on the interior of housing 11, branches out to form two parallel surfaces 23 each containing an elongate slot 24 formed to receive the pivot 47. Thus slot 24 and the opening 18 in the housing provide the necessary alignment limits of the sliding actuator relative the housing. Surfaces 23 furthermore pass on either side of bell crank 46, in the interspace therebetween and the distal legs of bracket 48, the details of this disposition being explicitly shown in FIG. 4. Thus the sliding actuator 20 is fixed both laterally and transversely in its freedom of motion and will therefore translate along the arrow A as set forth above. To provide the necessary bias for returning the actuator 20 back to its preactuating position, a spring 27 is shown connected between the interior end of one of the surfaces 23 and the interior of surface 17.

Once more by reference to FIGS. 2 and 4 actuator 20, at a point on the surfaces 23 adjacent slot 24, supports a first wrist pin 28 engaging one end of a connecting rod 29 which at its other end engages yet another wrist pin 49 in the free apex of bell crank 46. The disposition of wrist pin 28 is therefore eccentric relative the pivot 47 and a sliding articulation of the actuator 20 will concurrently articulate bell crank 46 in an arc around the pivot. To provide for the necessary claw engagement by which napkins 35 are to be advanced, bell crank 46 further includes a claw pin 50 which is directed into the opening or slot 40 and which by virtue of its alignment and the direction of motion of the bell crank will intercept the lower exposed surface of the napkin 35, advancing such napkin through the opening 15. It is to be noted that the incline of surface 31 relative the arc defined by the pivotal travel of pin 50 is such that an intercepting arch segment will exist during the articulation of the bell crank. The effect of this interception is expressly shown in FIG. 3 it being noted that the components of FIG. 3 illustrate the disposition of the same components as those shown in FIG. 2, this disposition being achieved in the course of articulation. As shown in FIG. 3 the direction of articulating motion of bell crank 46 is that shown by the arrow C and the direction of clawing alignment of pin 50 relative the bell crank is biased in the same manner. Thus during the inward stroke of actuator 20 the pin 50 will engage, as a claw, the exposed surface of the napkin 35. On the return stroke, the angular alignment of the pin precludes the necessary clawing engagement, lifting the napkin from surface 31 in the area adjacent the opening 40. Thus a dispensing mechanism is set out, by which napkins 35 can be manually dispensed one by one.

Thus by virtue of simple parts a preferred advancement direction is achieved, which one by one deploys napkins out of the container until fully depleted. It is to be noted that the napkins 35 require no spring forces in their retention and thus napkins of various strengths can be advanced through this clawing motion.

Obviously many modifications and variations to the above disclosure can be made without departing from the spirit of the invention. It is therefore intended that the scope of the invention be determined solely dependent on the claims attached hereto.

I claim:

1. A napkin dispenser comprising:

a housing including an upper chamber and lower chamber, said upper chamber having a hinged access cover forming a slot at the free end thereof, said cover and said upper chamber being conformed in rectangular mating planform;

a plurality of paper napkins arranged in a stack and disposed on the interior of said upper chamber, the lowermost one of said napkins being aligned in a substantially planar alignment with said slot; and a dispensing mechanism disposed on the interior of said lower chamber including a sliding actuator partly extending into said lower chamber from the exterior thereof, said sliding actuator having two substantially parallel surfaces joined at one end to form a forked structure receiving therebetween a bellcrank, each said surface further including an elongate slot disposed to receive a pivot for said bell crank the longitudinal alignment of said slots being common with the axis of sliding translation of said actuator, said bell crank disposed in the interior of said lower chamber and supported for pivotal motion around said pivot, said pivot extending to support said sliding actuator in translation, a connecting rod connected between said actuator and said bell crank for pivotally articulating said bell crank upon an inward translation of said actuator, said bell crank including a pin on the free end thereof arranged to extend into the interior of said upper chamber over a segment of said pivotal articulation of said bell crank for engaging said lowermost one of said napkins, and for dispensing said lowermost napkin out of said housing through said slot.

2. Apparatus according to claim 1 further comprising:

spring means disposed in said lower chamber for urging said actuator towards the exterior thereof.

3. Apparatus according to claim 2 further comprising:

manual articulating means formed on the exterior of said lower chamber and connected to said actuator for manual articulation thereof.

* * * * *